United States Patent [19]

Itani

[11] Patent Number: 4,635,753

[45] Date of Patent: Jan. 13, 1987

[54] NOISE CONVERTER

[75] Inventor: Jun Itani, Kobe, Japan

[73] Assignee: Ohhatsu Kabushiki Kaisha, Osaka, Japan

[21] Appl. No.: 760,798

[22] Filed: Jul. 31, 1985

[30] Foreign Application Priority Data

Jun. 17, 1985 [JP] Japan ..... 60-132623

[51] Int. Cl.[4] ..... F01N 1/10

[52] U.S. Cl. ..... 181/279; 181/239; 181/256; 181/272

[58] Field of Search ..... 181/279, 280, 241, 239, 181/256, 272, 274

[56] References Cited

U.S. PATENT DOCUMENTS 2,031,451 2/1936 Austin ..... 181/241

4,339,918 7/1982 Michikawa ..... 181/279 X

FOREIGN PATENT DOCUMENTS 309673 11/1955 France ..... 181/280

*Primary Examiner*—Benjamin R. Fuller

*Attorney, Agent, or Firm*—Armstrong, Nikaido, Marmelstein & Kubovcik

[57] ABSTRACT

A noise converter according to this invention is provided with gas conducting spiral passages defined between spirally twisted outer and inner tubes polygonal in cross-section. A gaseous body generating noise flows through the gas conducting passages from one end to the other. Since noise is generated by masses of particles of gaseous body having energy, particles of less energy move forward along a course near the center of each spiral passage whereas those of more energy along the other course near the outside of the passage due to centrifugal force, thereby dispersion and attenuation of energy being performed.

4 Claims, 4 Drawing Figures

NOISE CONVERTER

BACKGROUND OF THE INVENTION

1. Field of the Invention

This invention relates to a noise converter for reducing noise generated in exhaust and feed of gas.

2. Description of the Prior Art

For noise converters for such purpose as above, widely used is a structure in which the flow of gas is adapted to collide with baffle plates for attaining roundabout of gas in the passage so as to cause mutual interference and extinction of sound waves.

SUMMARY OF THE INVENTION

This invention was initiated in view of problems as above and the object thereof is to provide a noise converter that can be used even if small in diameter and has less resistance to the flow of gas.

To achieve the above object of this invention, gas conducting passages are defined between spirally twisted outer and inner tubes polygonal in cross-section.

A gaseous body generating noise flows through gas conducting passages from one end to the other. Since noise is generated by masses of particles of gaseous body having energy, particles of less energy move forward along a course near the center of each spiral passage whereas those of more energy along the other course near the outside of the passage due to centrifugal force, thereby dispersion and attenuation of energy being performed.

DESCRIPTION OF THE PREFERRED EMBODIMENTS

Figure 1:
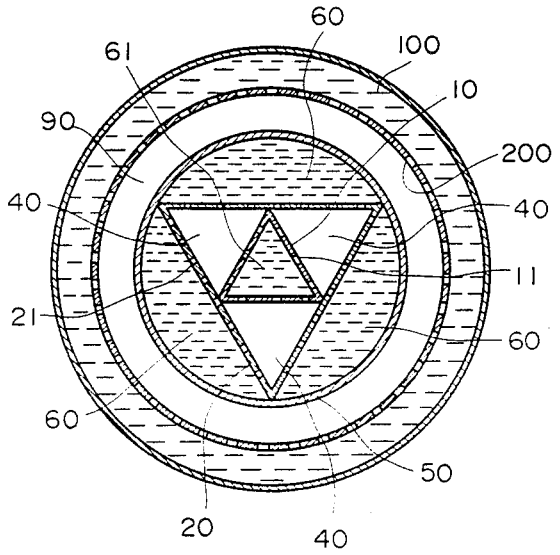
FIG. 1 is a sectional end view of a noise converter according to this invention taken at D—D, FIG. 2.
Figure 2:
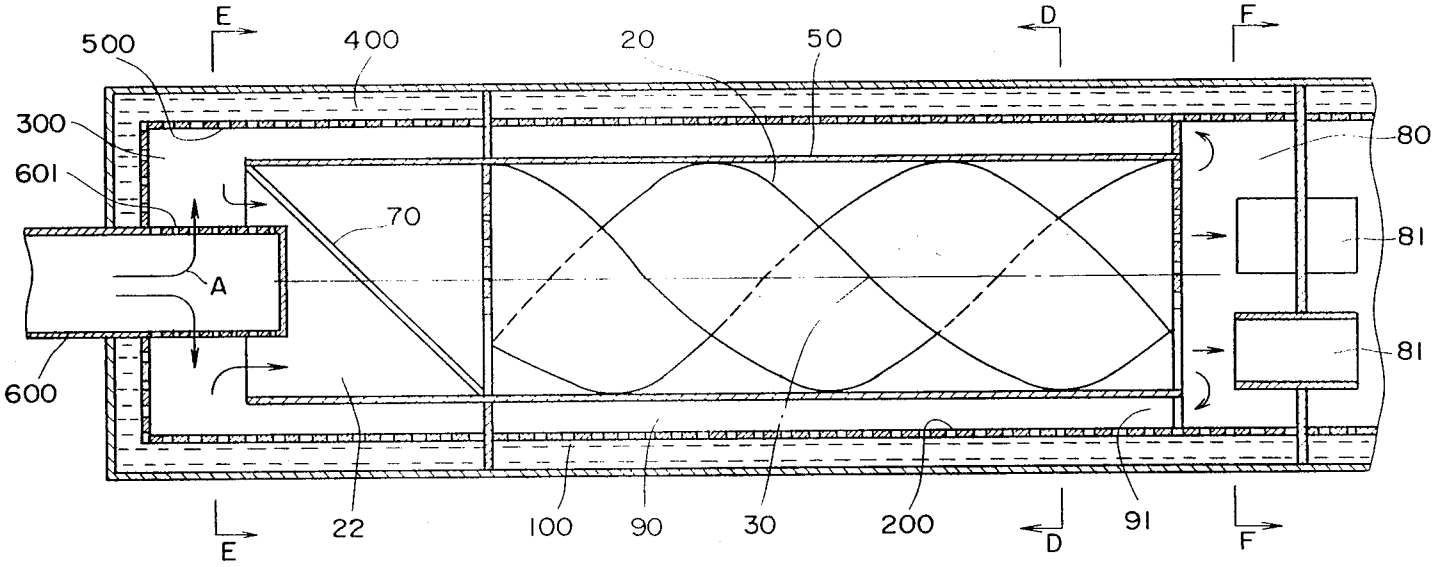
FIG. 2 is a partial sectional side view of the noise converter of FIG. 1 with spiral tube 20 shown in full view with perforations 21 and second absorbing material 60 omitted for purposes of clarity.

FIGS. 1 through 4 show a converter as an embodiment of this invention. In this drawing, reference numerals 10 and 20 indicate an inner tube and outer tube, respectively, which are all in such shape as obtained by spirally twisting a cross-sectionally triangular tubular body in one direction. The inner tube 10 is arranged in outer tube 20 concentrically therewith and, between these two tubes, three cross-sectionally triangular spiral passages 40 for conducting the flow of gas are defined so as to extend around the center line 30 of the converter. The outer tube 20 is inserted into a container cylinder 50 concentrically therewith to be supported therewithin and covered by a sound-absorbing material 60 such as rock wool and asbestos filled in the space defined against the container cylinder 50 and along the spiral of this tube. The inner tube 10 is also filled with a sound-absorbing material 61. All the gas conducting spiral passages 40 communicate with chambers filled with above said sound absorbing materials 60 and 61 through a large number of perforations 21 and 11 provided on the outer tube 20 and inner tube 10, respectively.

Figure 3:
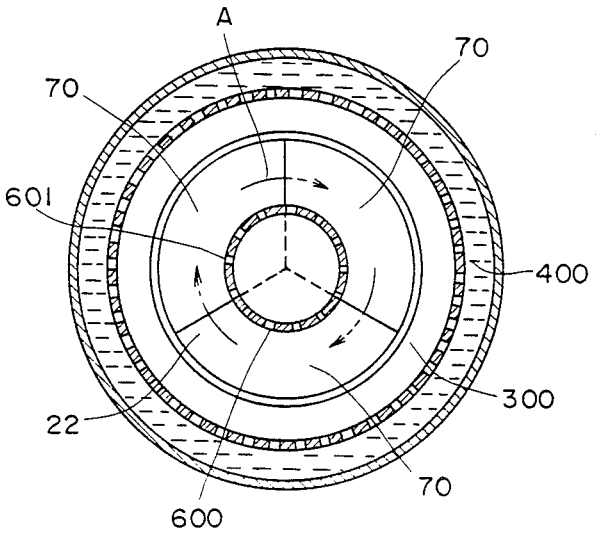
FIG. 3 is a sectional view taken along the line E—E in FIG. 2.
Figure 4:
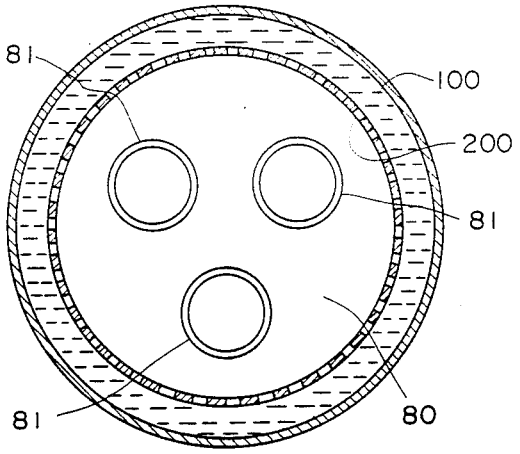
FIG. 4 is a sectional view taken along the line F—F in FIG. 2.

An opening at one end of the outer tube 20 is a gas inlet chamber 22 prepared for three gas conducting spiral passages 40, which is provided with three vanes 70 for spirally whirling and forwardly driving gas, as shown by the arrow mark A in FIG. 3, along the twisting direction of the gas conducting spiral passages 40. A gas outlet chamber 80 for the gas conducting spiral passages 40 is formed at an opening part at the other end of the outer tube 20, which is provided with three flow-rectifying outlets 81.

The outer periphery of the above said container cylinder 50 is covered with a sound-absorbing material 100 extending apart from the cylinder with a space 90 provided therebetween, and the chamber filled with the sound-absorbing material 100 communicates with the annular space 90 and gas outlet chamber 80 through a great number of perforations 200 as well as the downstream end 91 of the annular space 90 communicates with the gas outlet chamber 80.

On the other hand, the gas inlet chamber 22 is covered with a sound absorbing material 400 at the outer periphery and front part while providing a head chamber 300 for keeping the gas inlet chamber 22 apart from the sound absorbing material. The space filled with this sound-absorbing material 400 communicates with the head chamber 300 through a large number of perforations 500 and the head chamber 300 has a great number of gas passing perforations 601 provided on the front peripheral part of a gas feeding pipe 600.

Then, the action of the abovesaid structure will be described.

Gas A spouted through the gas passing perforations 601 of the gas feeding pipe 600 fills the closed head chamber 300, enters the gas conducting spiral passages 40, 40, and 40 while being whirled by vanes 70 in the gas inlet chamber 22, and, after passing through the inner parts of spiral passages 40, flows into flow-rectifying outlet pipes 81 from the gas outlet chamber 80.

In the abovesaid flow of gas, noise generated thereby is absorbed by:

(1) the sound-absorbing material 400 after passing through perforations 500 in the head chamber 300;

(2) the sound-absorbing materials 60 and 61 after passing through the perforations 21 and 11 in the gas conducting spiral passages 40, 40, and 40;

(3) the sound-absorbing material 100 after passing through the annular space 90 and perforations 200; whereby the level of noise is lowered, particularly, to a great degree by the centrifugal effect exerted within the gas conducting passages 40, 40, and 40. The details of the above action will be described hereunder.

Inner parts of the gas conducting passages 40, 40, and 40 are formed into closed spaces in the radial direction and walls of the closed space compose a polygonal body having no knot. Sound waves causing noise, when entering the gas conducting passage 40, repeatedly collide with walls of the polygonal body in the closed space and move forward while dispersed and attenuated. The gas advancing while surrounded by the walls moves spirally. As a result, particles having less energy causing noise move forward along a course near the center of the spiral passage 40 whereas particles having more energy along the other course near the outside of the passage 40, whereby dispersion and attenuation of energy are performed due to a difference in distance of movement between two kinds of particles and noise suppression effect can be obtained.

A noise converter of such a structure as above is capable of, when used in, for example, the muffler of an engine, avoids a decrease in output of the engine thanks to a low degree of resistance thereof to the flow of gas and resulting less influence on the back pressure of the engine. Moreover, since the spiral passage 40 is used as a sound suppressing passage, a diameter of the muffler can be reduced smaller than that of a muffler of "collision and roundabout system" referred to in the description of the conventional converter.

The shape of gas conducting spiral passage 40 is not limited to a cross-sectionally triangular one as shown in the drawings and may be of a polygon enclosed by a large number of sides, and it is apparently possible to optionally set the number of spiral passages 40.

The invention is applicable to exhaust flow of not only the engine but also apparatus in the other industrial fields or the noise converter for gas feeding.

As apparent from the above description, a noise converter of this invention, in which gas is passed through spaces defined between spirally twisted outer and inner tubes polygonal in cross-section, attenuates noise caused in the gaseous body, with less resistance to the flow of gas, and capable of being made smaller in outer diameter.

I claim:

1. A noise converter comprising an outer spirally twisted tube having a polygonal cross-section, an inner spirally twisted tube having a polygonal cross-section and disposed within said outer tube, said inner and outer tubes spirallying in the same direction and forming gas conducting spiral passages therebetween, and an outer cylindrical container into which said outer tube with said inner tube therein is inserted for supporting said outer and inner tubes, a gas inlet at one end of said tubes and a gas outlet at the other end of said tubes.

2. A noise converter, as recited in claim 1 in which said spirally twisted, polygonal cross-section outer and inner tubes are triangular in cross-section.

3. A noise converter, as recited in claim 2 in which said gas conducting spiral passages between said outer and inner spiral tubes are triangular in cross-section.

4. A noise converter, as recited in claim 3, in which the walls of said outer and inner spiral tubes are perforated and said inner spiral tube and the space between said outer spiral tube and said outer cylindrical container are filled with a sound absorbing material.

* * * * *